US012797668B2

(12) United States Patent
Long

(10) Patent No.: US 12,797,668 B2
(45) Date of Patent: Nov. 17, 2026

(54) FITNESS EQUIPMENT CLAMPING DEVICE

(71) Applicant: Shenzhen Yaoshun E-commerce Co., Ltd., Shenzhen (CN)

(72) Inventor: Kaishun Long, Shenzhen (CN)

(73) Assignee: Shenzhen Yaoshun E-commerce Co., Ltd., Shenzhen (CN)

( * ) Notice: Subject to any disclaimer, the term of this patent is extended or adjusted under 35 U.S.C. 154(b) by 0 days.

(21) Appl. No.: 19/439,354

(22) Filed: Jan. 3, 2026

(65) Prior Publication Data

US 2026/0192145 A1 Jul. 9, 2026

(30) Foreign Application Priority Data

Jan. 8, 2025 (CN) ..... 202520042909.7

(51) Int. Cl.
*A63B 21/072* (2006.01)

(52) U.S. Cl.
CPC ..... *A63B 21/0722* (2015.10); *A63B 21/0726* (2013.01)

(58) Field of Classification Search
CPC ..... A63B 21/06; A63B 21/072–075; A63B 21/4033–4035; A63B 2244/09; F16B 7/048; Y10T 403/7182
See application file for complete search history.

(56) References Cited

U.S. PATENT DOCUMENTS 9,630,045 B1 * 4/2017 Martin, Sr. ..... A63B 21/4049
11,179,588 B2 * 11/2021 McCall ..... A63B 1/00
11,752,385 B2 * 9/2023 Abbott ..... A63B 21/0722 482/106
12,285,644 B1 * 4/2025 Wang ..... A63B 21/072
12,527,987 B2 * 1/2026 Hao ..... A63B 21/0728
2011/0173778 A1 * 7/2011 Wales ..... B25G 3/20 16/426
2011/0177922 A1 * 7/2011 Selinger ..... A63B 21/0724 482/107
2013/0210589 A1 * 8/2013 Thompson ..... A63B 21/0726 482/108
2014/0018214 A1 * 1/2014 Jordan ..... A63B 21/072 482/107
2014/0024506 A1 * 1/2014 Vixathep ..... A63B 21/0726 482/108
2022/0339487 A1 * 10/2022 Dickstein ..... A63B 21/0722
2025/0152993 A1 * 5/2025 Qi ..... A63B 21/0557

* cited by examiner

*Primary Examiner* — Megan Anderson
*Assistant Examiner* — Kathleen M Fisk

(57) ABSTRACT

A fitness equipment clamping device is disclosed, comprising a connection mechanism having a handle at a top portion thereof; a support device disposed at a bottom portion of the connection mechanism; and a clamping device disposed below the connection mechanism, wherein the connection mechanism is detachably connected to the clamping device via the support device; and a U-shaped groove is formed between the connection mechanism and the clamping device, the U-shaped groove being configured to receive and secure a handle portion of fitness equipment. The fitness equipment clamping device has a reasonable structure, high practicality, simple assembly and disassembly, flexible use, and convenient operation.

10 Claims, 9 Drawing Sheets

FITNESS EQUIPMENT CLAMPING DEVICE

TECHNICAL FIELD

The present invention relates to the technical field of fitness equipment clamps, and more particularly to a fitness equipment clamping device.

BACKGROUND OF THE INVENTION

In the field of fitness and exercise equipment, the design and function of clamps and fixing devices play a crucial role in ensuring user safety and equipment versatility. Traditional clamps, which typically employ a hinged opening and closing structure, have been widely used to secure various types of exercise equipment, such as dumbbells. However, these conventional designs have inherent limitations, particularly in terms of adaptability and ease of use. The fixed-size openings created by hinged structures can only accommodate dumbbells of specific diameters, limiting their compatibility with dumbbells of various sizes available on the market. This lack of flexibility may lead to instability during exercise, posing potential safety risks to users.

Additionally, the assembly and disassembly processes of these traditional clamps can be cumbersome, often requiring multiple steps that degrade the user experience. As fitness enthusiasts seek more efficient and user-friendly solutions, the demand for innovative clamp designs has grown. Such designs should provide ease of use and enhanced safety features. There is a clear need for a more adaptable and safer clamping mechanism, which not only improves the convenience of assembling and disassembling exercise equipment but also ensures the equipment remains secure during use, thereby reducing the risk of accidents and enhancing the overall exercise experience.

SUMMARY OF THE INVENTION

The primary object of the present invention is to provide a fitness equipment clamping device having a reasonable structure, high practicality, simple assembly and disassembly, flexible use, and convenient operation.

To achieve the above object, the present invention provides a fitness equipment clamping device, comprising: a connection mechanism having a handle at a top portion thereof; a support device disposed at a bottom portion of the connection mechanism; and a clamping device disposed below the connection mechanism, wherein the connection mechanism is detachably connected to the clamping device via the support device; and a groove is formed between the connection mechanism and the clamping device to receive a portion of fitness equipment.

Optionally, the connection mechanism has an umbrella-shaped configuration, and the support device comprises a first support plate and a second support plate, the first support plate and the second support plate being respectively disposed at opposite ends of the bottom portion of the connection mechanism.

Optionally, external threads are respectively formed on outer surfaces of the first support plate and the second support plate.

Optionally, the handle includes a nut member disposed therein.

Optionally, the clamping device comprises a knob assembly including a boss, and the support device is connected to the knob assembly via the boss.

Optionally, opposite sides of the boss respectively include a first limiting portion and a second limiting portion, the first limiting portion and the second limiting portion being positioned to correspond to the first support plate and the second support plate, and the first support plate and the second support plate being respectively connected to the knob assembly through the first limiting portion and the second limiting portion.

Optionally, a top surface of the boss includes a cushioning pad.

Optionally, a back side of the boss includes a boss cavity, the boss cavity containing a hollow first tubular post; the knob assembly includes a knob cavity, the knob cavity including a knob post positioned to correspond to the first tubular post, the knob post being insertably engageable with the first tubular post.

Optionally, second and third tubular posts are respectively disposed on left and right sides of the first tubular post.

Optionally, internal threads are formed on an inner wall of the knob assembly.

Advantages of the Invention

The fitness equipment clamping device of the present invention comprises: a connection mechanism having a handle at a top portion thereof; a support device disposed at a bottom portion of the connection mechanism; and a clamping device disposed below the connection mechanism, wherein the connection mechanism is detachably connected to the clamping device via the support device; and a groove is formed between the connection mechanism and the clamping device to receive a portion of fitness equipment.

Through the above structural arrangement, the present invention has a reasonable structure, facilitates clamping of fitness equipment, provides simpler assembly and disassembly, more flexible operation, and greater convenience; significantly improves the efficiency of clamping fitness equipment, and enhances user experience.

The present invention has strong practicality, is safe and reliable in use, and is suitable for widespread promotion and application.

BRIEF DESCRIPTION OF DRAWINGS

To more clearly illustrate the technical solutions in the embodiments of the present invention or the prior art, the drawings required for describing the embodiments or the prior art will be briefly introduced below. Obviously, the drawings described below are merely some embodiments of the present invention. For those of ordinary skill in the art, other drawings can be obtained based on these drawings illustrated structures without creative efforts.

Figure 1:
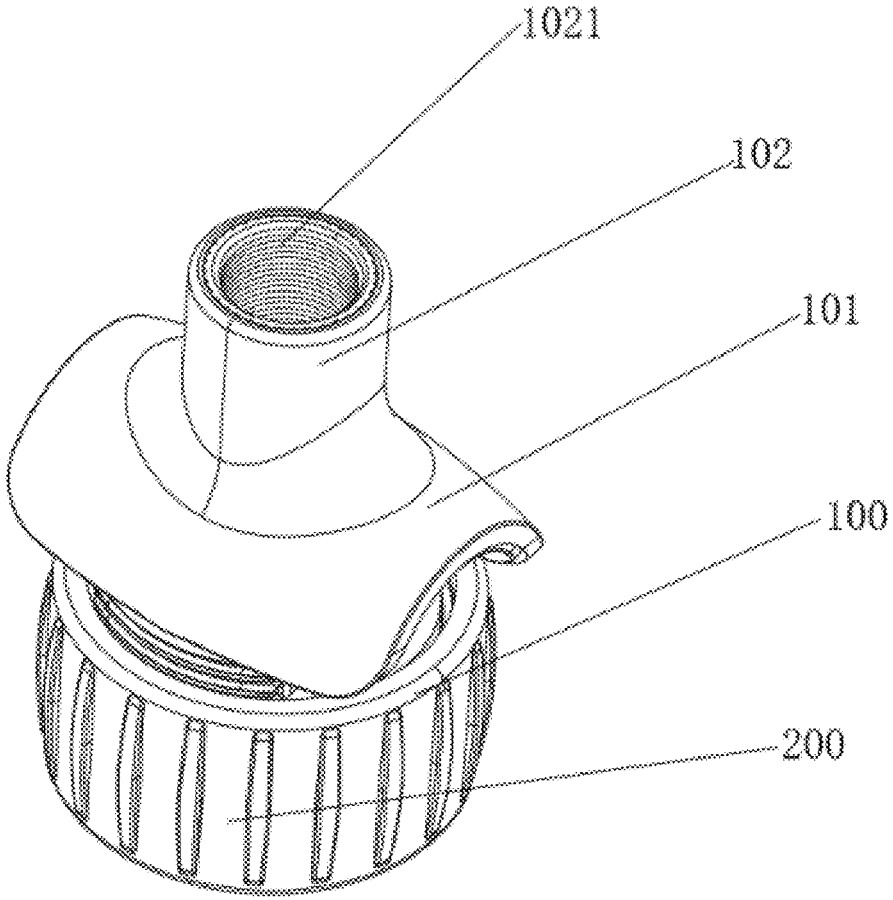
FIG. 1 is a schematic structural diagram of one embodiment of the fitness equipment clamping device of the present invention.
Figure 2:
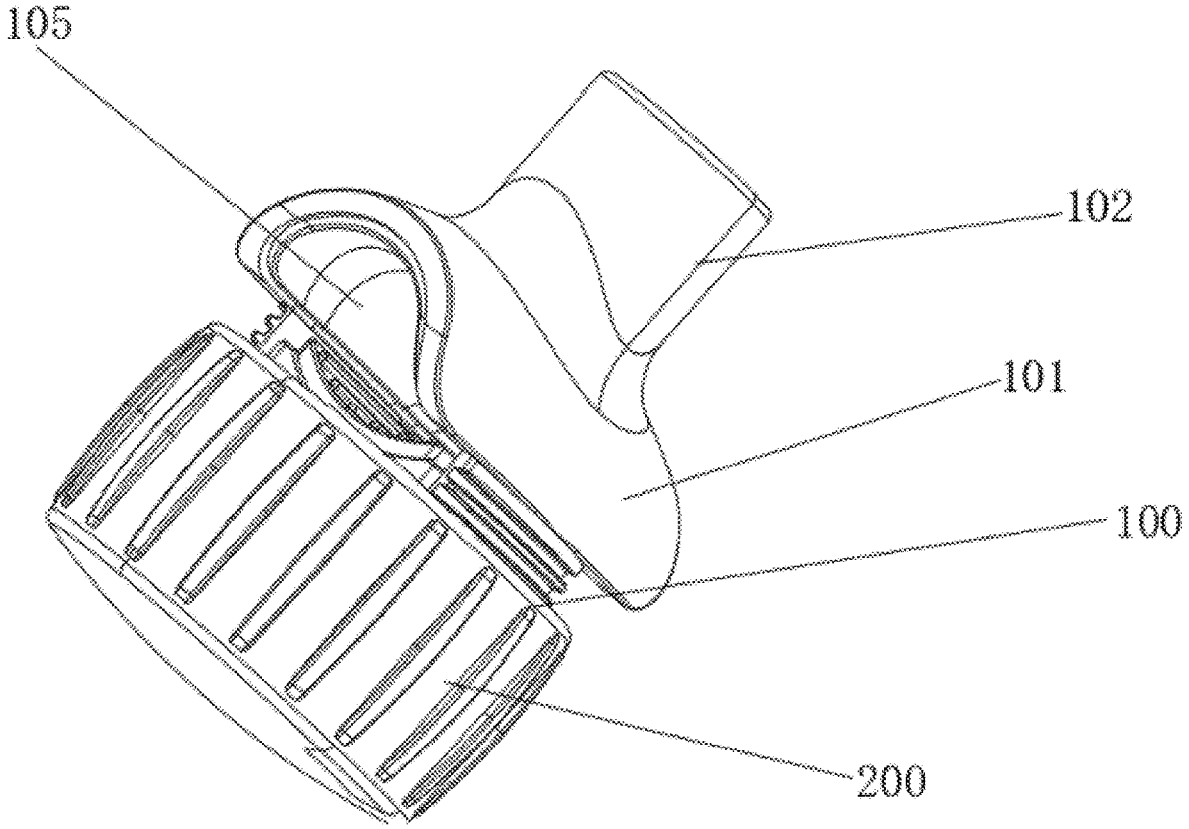
FIG. 2 is another schematic structural diagram of one embodiment of the fitness equipment clamping device of the present invention.

Reference Numerals: Fitness equipment clamping device (100); Connection mechanism (101); Handle (102); Handle hole (1021); Nut member (1022); First support plate (103); First external thread (1031); Second support plate (104); Second external thread (1041); Clamping device (200); Knob assembly (201); Knob cavity (2011); Knob post (2012); Internal thread (2013); Recess (2014); U-shaped groove (105); Boss (202); Boss cavity (2021); First tubular post (2022); First limiting portion (2023); Second limiting portion (2024); Second tubular post (2025); Third tubular post (2026); Top platform of boss (2027); Cushioning pad (203); Dumbbell (204).

DETAILED DESCRIPTION OF THE INVENTION

The embodiments of the present invention will be described clearly and completely below with reference to the accompanying drawings. It should be understood that the described embodiments are merely part of, rather than all, of the embodiments of the present invention. Based on the embodiments of the present invention, all other embodiments obtained by those of ordinary skill in the art without creative efforts fall within the scope of protection of the present invention.

It should be noted that all directional indications (such as up, down, left, right, front, back, etc.) in the embodiments of the present invention are merely used to explain the relative positional relationships and movement conditions between the components under a certain posture (as shown in the drawings). When the posture changes, the corresponding directional indications should be adjusted accordingly.

In the present invention, unless otherwise expressly specified and limited, the terms "connected" and "fixed" should be understood in a broad sense. For example, "fixed" may refer to fixed connection, detachable connection, or integrally formed; may refer to mechanical connection or electrical connection; may refer to direct connection or indirect connection via an intermediate medium; and may also refer to communication between internal portions of two elements or an interaction relationship between two elements, unless otherwise expressly limited. For those of ordinary skill in the art, the specific meanings of the above terms in the present invention can be understood according to the specific context.

In addition, if "first", "second", and the like are involved in the embodiments of the present invention, such "first" and "second" are merely used for description, and should not be understood as indicating or implying relative importance, nor should they be understood as implying any limitation on the number of the indicated technical features. Thus, a feature defined as "first" or "second" may expressly or implicitly include one or more such features. Furthermore, the term "and/or" as used throughout the specification refers to three alternative solutions, such that, for example, "A and/or B" encompasses solution A alone, solution B alone, and solution A and solution B in combination. Moreover, the technical solutions among the respective embodiments may be combined with one another, provided that such a combination can be implemented by those of ordinary skill in the art. When a combination of technical solutions appears mutually contradictory or cannot be implemented, it should be deemed that such a combination does not exist and is not within the scope of protection required by the present invention.

The present invention provides a fitness equipment clamping device.

EMBODIMENT 1

Referring to FIGS. 1 to 7 and FIG. 9, in one embodiment of the present invention, a fitness equipment clamping device (100) is provided. The fitness equipment clamping device (100) comprises a connection mechanism (101), a handle (102) disposed at a top portion of the connection mechanism (101), and a support device disposed at a bottom portion of the connection mechanism (101). Preferably, the support device comprises a first support plate (103) and a second support plate (104), the first support plate (103) and the second support plate (104) being respectively disposed at left and right ends of the connection mechanism (101).

A clamping device (200) is disposed below the connection mechanism (101). The connection mechanism (101) is detachably connected to the clamping device (200) via the support device, and a U-shaped groove (105) is formed between the connection mechanism (101) and the clamping device (200) to receive fitness equipment. Preferably, the U-shaped groove (105) configured to receive fitness equipment is formed between the connection mechanism (101) and the clamping device (200) to receive fitness equipment.

In this embodiment, the handle (102) at the top of the connection mechanism (101) can be connected to a component of fitness equipment, such as a bar of a barbell. Preferably, a handle hole (1021) is formed at a top portion of the handle (102), and a bar portion of the fitness equipment can extend through the handle hole (1021) to be connected to the connection mechanism (101).

Referring to FIGS. 3, 4, 5, and 9, in this embodiment, the connection mechanism (101) is connected to the clamping device (200) via the first support plate (103) and the second support plate (104), and the U-shaped groove (105) configured to receive fitness equipment is formed between the connection mechanism (101) and the clamping device (200). Preferably, the U-shaped groove (105) has a cross-section sized to accommodate a handle portion of fitness equipment.

The fitness equipment may, for example, be a dumbbell (204). A dumbbell bar of the dumbbell (204) can be placed between the first support plate (103) and the second support plate (104) and clamped on one side of the dumbbell bar by the connection mechanism (101). The clamping device (200) then clamps an opposite side of the dumbbell bar via the first support plate (103) and the second support plate (104), so that the dumbbell bar is received within the U-shaped groove (105) and the dumbbell (204) is clamped by the fitness equipment clamping device (100).

The connection mechanism (101) and the clamping device (200) thereby form a U-shaped groove (105) configured to securely position fitness equipment. The U-shaped groove (105) facilitates passage of a central portion of the fitness equipment therethrough, ensuring proper alignment and stability during use. The connection mechanism (101) further creates a holding space between the handle (102) and the clamping device (200), such that relative movement of the clamping device (200) progressively tightens the fitness equipment positioned within the holding space, thereby effectively securing the clamped member.

The U-shaped groove (105) is formed between the connection mechanism (101) and the clamping device (200) and is designed to be aligned with a center portion of the fitness equipment, thereby facilitating passage of the central portion of the fitness equipment therethrough. The fitness equipment interacts with the connection mechanism in this manner.

Figure 3:
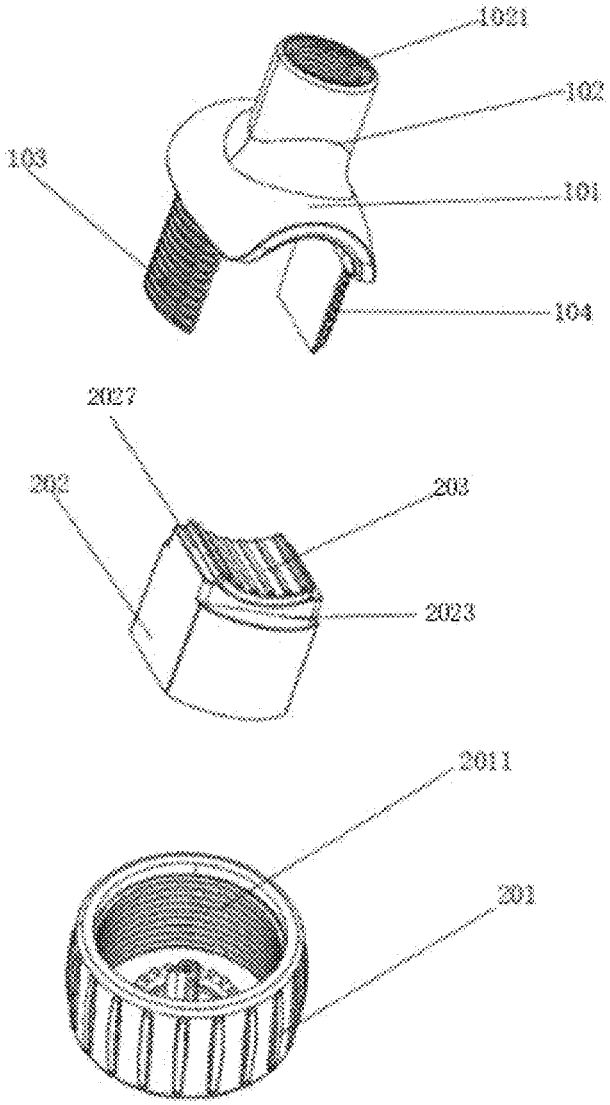
FIG. 3 is an exploded schematic diagram of one embodiment of the fitness equipment clamping device of the present invention.
Figure 4:
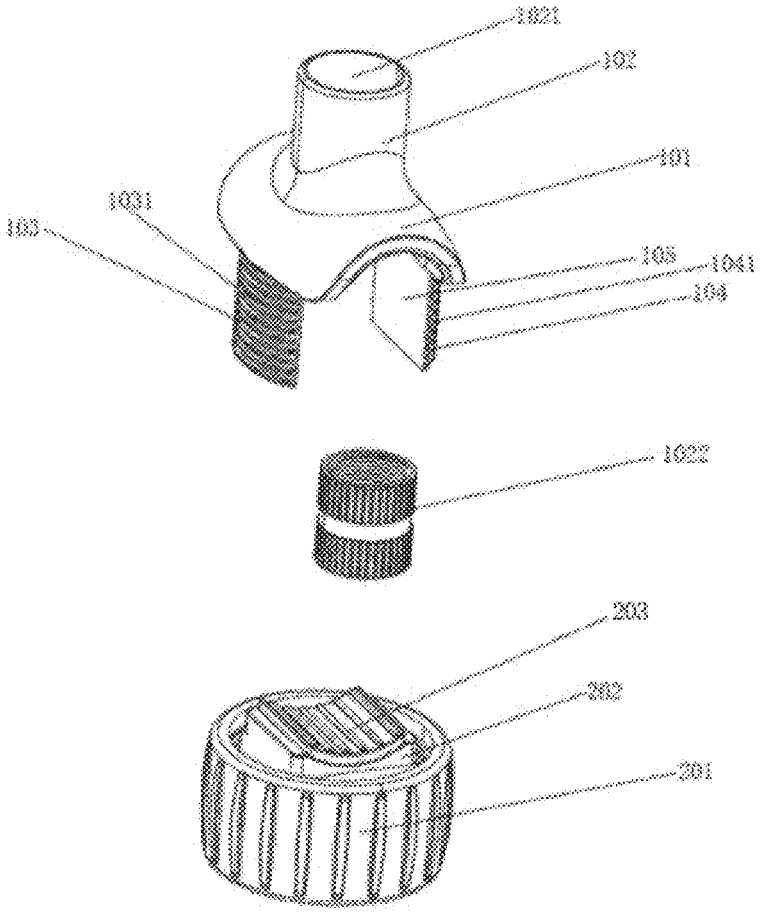
FIG. 4 is another exploded schematic diagram of one embodiment of the fitness equipment clamping device of the present invention.
Figure 5:
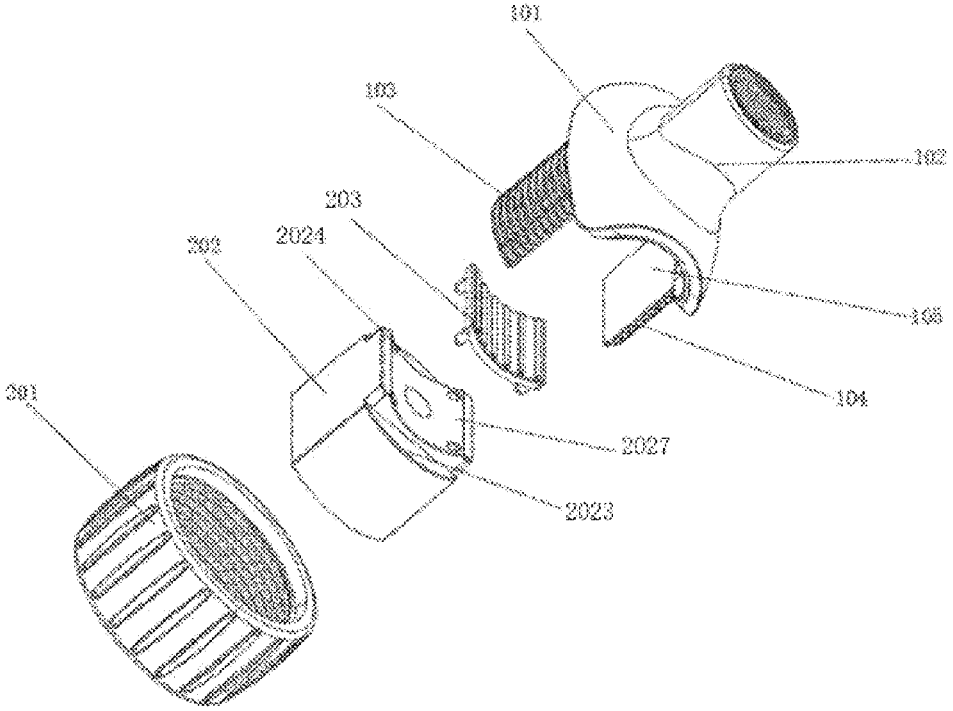
FIG. 5 is a third exploded schematic diagram of one embodiment of the fitness equipment clamping device of the present invention.
Figure 6:
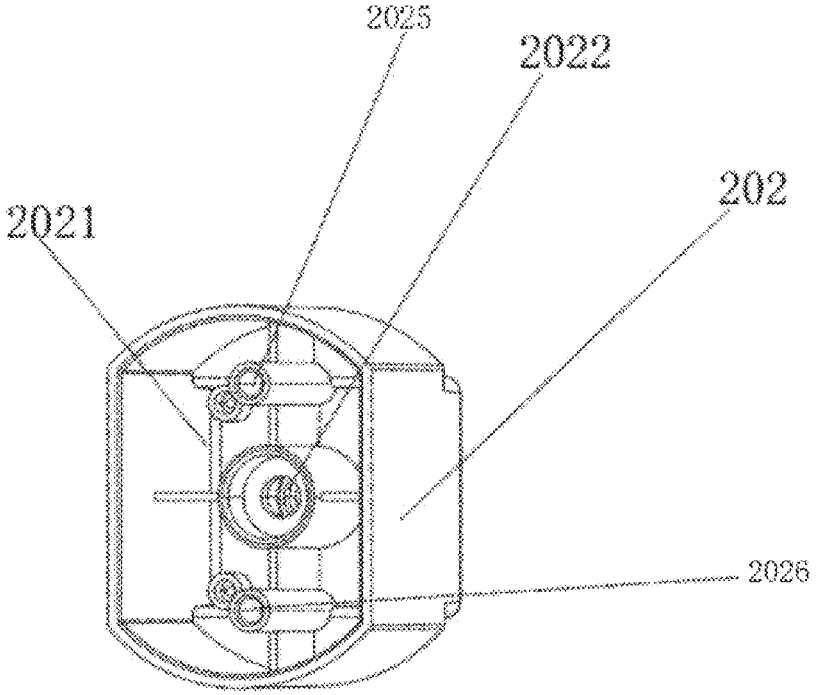
FIG. 6 is a schematic diagram of the boss structure of one embodiment of the fitness equipment clamping device of the present invention.
Figure 7:
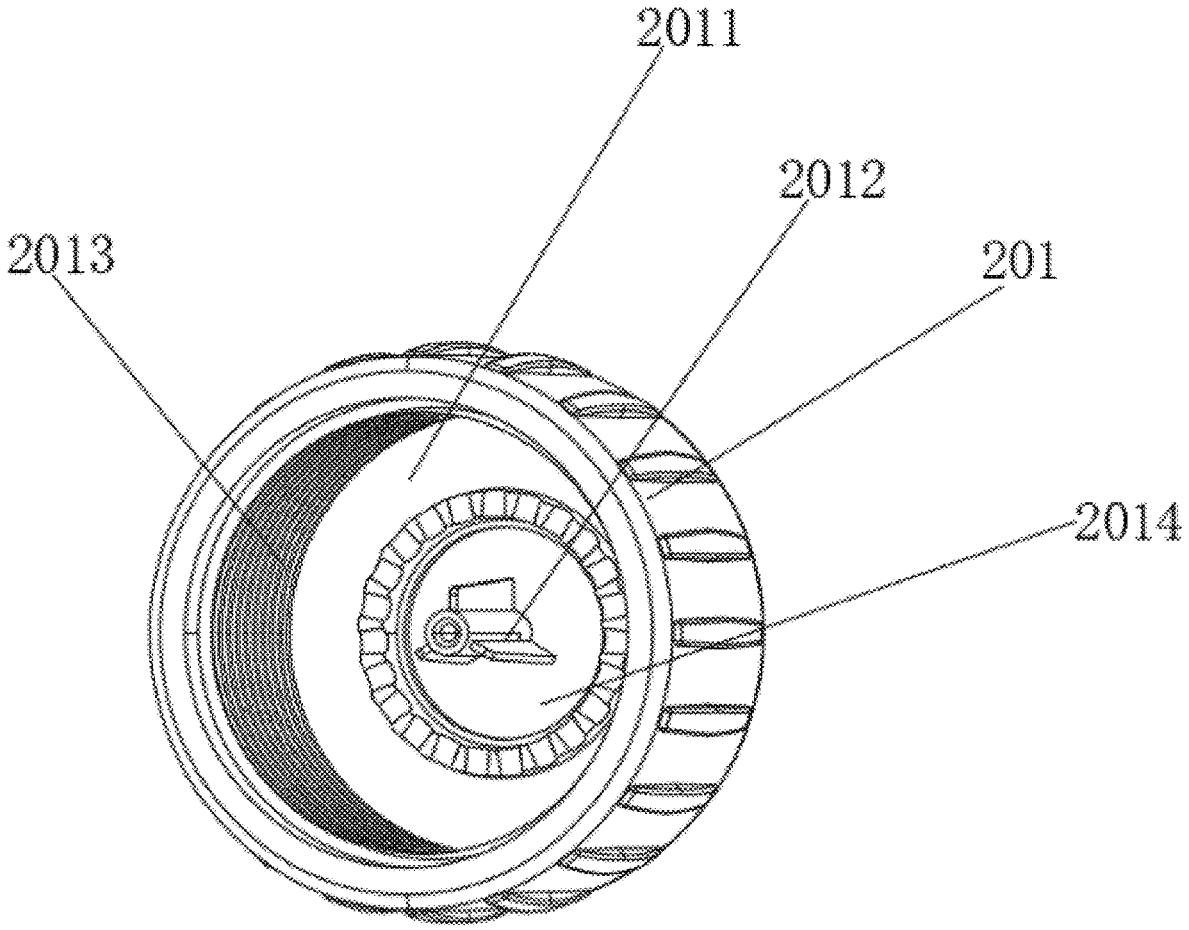
FIG. 7 is a schematic diagram of the knob assembly structure of one embodiment of the fitness equipment clamping device of the present invention.

Referring to FIGS. 3, 4, and 5, in this embodiment, preferably, a nut member (1022) is disposed within the handle (102). The nut member (1022) is arranged inside the handle (102) such that when a component of fitness equipment is inserted into the handle (102), the connection mechanism (101) can be conveniently screwed together with the external fitness equipment component by means of the nut member (1022), thereby providing more convenient and flexible use.

The handle (102) enables a user to operate the clamping device (200), and the connection mechanism (101) forms a holding space between the handle (102) and the clamping device (200). The connection mechanism (101) allows the clamping device (200) to move relative to the handle (102) to progressively tighten the fitness equipment, thereby ensuring secure fixation.

Referring to FIGS. 3, 4, and 5, in this embodiment, preferably, a first external thread (1031) and a second external thread (1041) are respectively formed on outer sides of the first support plate (103) and the second support plate (104).

Referring to FIGS. 3, 4, 5, 6, and 7, in this embodiment, preferably, the clamping device (200) comprises a knob assembly (201), and a boss (202) is disposed within the knob assembly (201). The support device is connected to the knob assembly (201) via the boss (202).

In this embodiment, the knob assembly (201) is disk-shaped and comprises a knob cavity (2011). An internal thread (2013) is formed on an inner wall of the knob cavity (2011). Since the first external thread (1031) and the second external thread (1041) are respectively formed on outer sides of the first support plate (103) and the second support plate (104), the knob assembly (201) is threadedly engaged with the first external thread (1031) and the second external thread (1041) via the internal thread (2013), so that the clamping device (200) clamps the fitness equipment, thereby providing more convenient and flexible use.

In this embodiment, preferably, opposite sides of the boss (202) respectively comprise a first limiting portion (2023) and a second limiting portion (2024). The first limiting portion (2023) and the second limiting portion (2024) are positioned to correspond to the first support plate (103) and the second support plate (104), and the first support plate (103) and the second support plate (104) are respectively connected to the knob assembly (201) via the first limiting portion (2023) and the second limiting portion (2024).

In this embodiment, the boss (202) further comprises a top platform (2027). The first limiting portion (2023) and the second limiting portion (2024) are disposed on opposite sides of the top platform (2027), and heights of the first limiting portion (2023) and the second limiting portion (2024) are slightly lower than a height of the top platform (2027). One ends of the first support plate (103) and the second support plate (104) are respectively connected to opposite ends of the connection mechanism (101), and opposite ends of the first support plate (103) and the second support plate (104) are respectively connected to the first limiting portion (2023) and the second limiting portion (2024). When it is desired to clamp fitness equipment, the knob assembly (201) may first be removed, the fitness equipment may be clamped between the first support plate (103) and the second support plate (104) along the boss (202), and then the boss (202) may be tightened by means of the knob assembly (201) so as to clamp the fitness equipment.

In this embodiment, further preferably, a cushioning pad (203) is provided on a top surface of the boss (202). The cushioning pad (203) is disposed on the top platform (2027) of the boss (202). The cushioning pad (203) provides a frictional and cushioning effect against an outer wall of the fitness equipment. This arrangement can prevent loosening and lateral deflection, ensuring that the equipment remains securely clamped.

A cushioning layer formed by the cushioning pad (203) of the clamping device (200) generates friction with the fitness equipment and closely abuts against the outer wall of the fitness equipment, thereby providing a cushioning effect to prevent the fitness equipment from loosening and laterally deflecting. The cushioning pad (203) is an important part of the clamping device (200), enhancing alignment and stability and making the present invention safer and more reliable to use.

In this embodiment, the cushioning pad (203) provides friction to enhance stability and prevent lateral deflection. This ergonomic design ensures repeated use and ease of operation.

In this embodiment, the fitness equipment clamping device (100) fixed to the fitness equipment safely clamps fitness equipment of different diameters by forming the holding space and realizing progressive tightening. The handle (102) and the clamping device (200) are connected so as to ensure that the U-shaped groove (105) can stably clamp the fitness equipment to fix the fitness equipment. The cushioning pad (203) provides additional stability and alignment, ensuring that the equipment remains secure during use. The device is made of durable materials capable of withstanding repeated use and forces during clamping, making it a reliable tool for fitness enthusiasts.

Referring to FIGS. 3, 4, 5, 6, and 7, in this embodiment, preferably, a boss cavity (2021) is provided on a back side of the boss (202), and a hollow first tubular post (2022) is disposed within the boss cavity (2021). The knob assembly (201) defines the knob cavity (2011), and the knob cavity (2011) includes the knob post (2012). A position of the knob post (2012) corresponds to a position of the first tubular post (2022), and the knob post (2012) is insertably engaged with the first tubular post (2022).

In this embodiment, the boss (202) is fixedly connected to the knob assembly (201) by inserting the knob post (2012) into the first tubular post (2022), thereby providing a more stable and secure structure.

In this embodiment, further preferably, second and third tubular posts (2025) and (2026) are respectively disposed on left and right sides of the first tubular post (2022). The second tubular post (2025) and the third tubular post (2026) may be connected to the first tubular post (2022) via reinforcing ribs, so that the boss (202) is more robust and durable. The knob cavity (2011) further includes the recess (2014). When the boss (202) is inserted into the knob cavity (2011), the second tubular post (2025) and the third tubular post (2026) are respectively inserted into the recess (2014) and abut against a bottom of the recess (2014), thereby supporting the boss (202) relative to the knob assembly (201).

Figure 8:
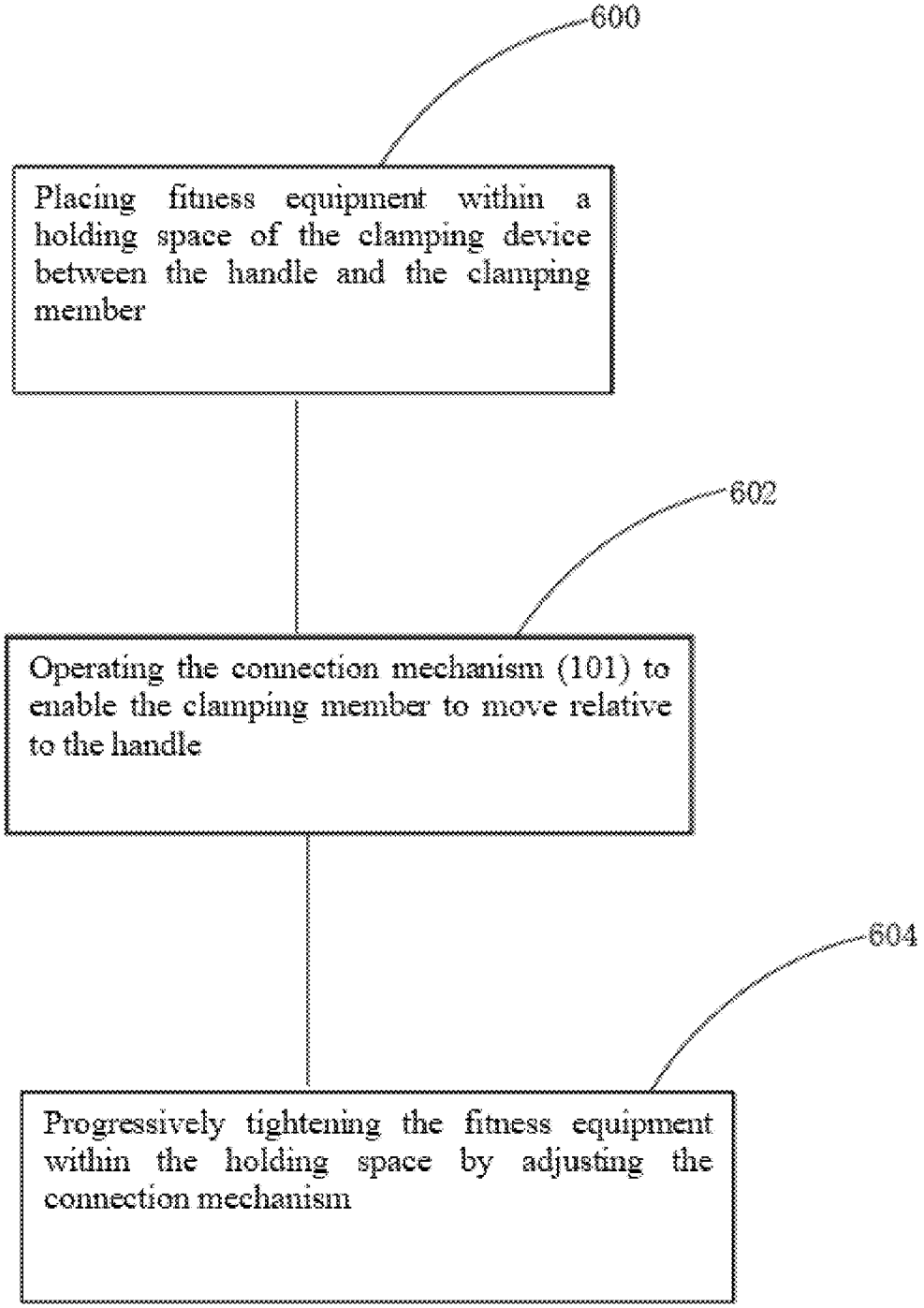
FIG. 8 is a flowchart of the operation method of one embodiment of the fitness equipment clamping device of the present invention.
Figure 9:
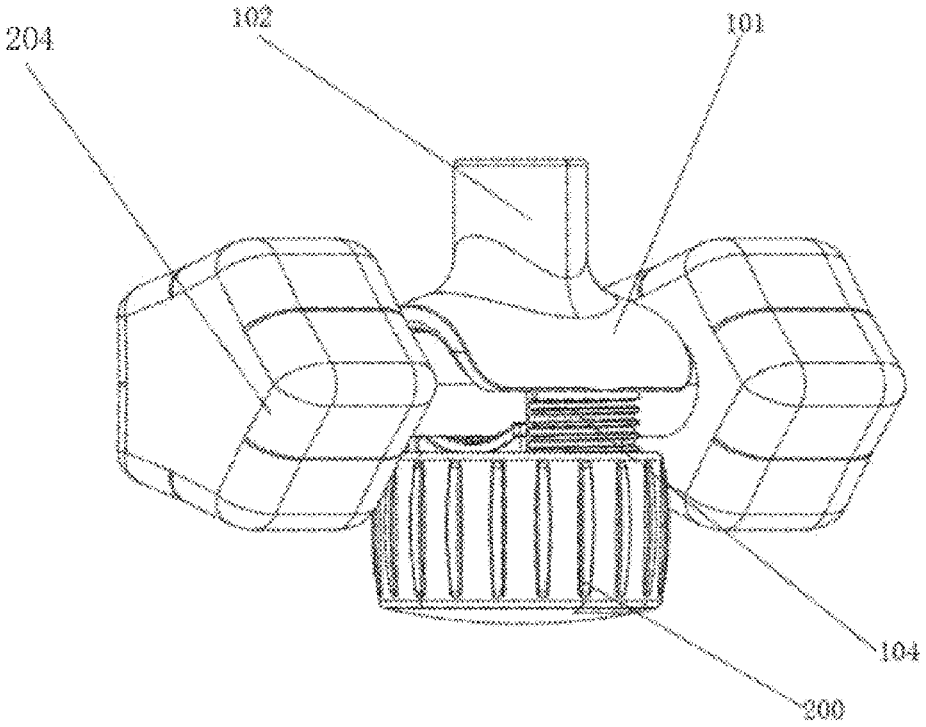
FIG. 9 is a schematic diagram of the use state of one embodiment of the fitness equipment clamping device of the present invention.

Referring to FIG. 8, FIG. 8 illustrates, in detail, a flowchart of a method of using the fitness equipment clamping device (100) to secure fitness equipment. The flowchart provides a guide to an operation method. The method starts at step 600, in which fitness equipment is positioned within the holding space formed between the handle (102) of the clamping device (200) and the connection mechanism (101). This initial step is critical because it ensures that the fitness equipment is correctly placed in a designated region, thereby allowing effective clamping and laying the foundation for subsequent operations. The holding space is created by the connection mechanism (101) and is an indispensable functional portion of the device, because it allows relative movement between a clamping member and the handle (102).

At step 602, the connection mechanism (101) is operated to allow the clamping member to move relative to the handle (102). This operation is essential for adjusting the position of the clamping member so that it can accommodate fitness equipment of various sizes and shapes. The connection mechanism (101) may include features such as the U-shaped groove (105) or a cushioning pad, which facilitate threading and positioning of the fitness equipment. These features ensure that the equipment is securely fixed, prevent slipping, and provide stability during use.

Step 604 involves progressively tightening the fitness equipment within the holding space by adjusting the connection mechanism (101). This step ensures that the equipment is firmly held, allowing safe and effective use. The progressive tightening mechanism may involve various structures, such as snap structures, magnetic adsorption structures, or adhesive structures, which enhance the ability of the clamping device (200) to securely fix the equipment. The flowchart effectively captures the essence of the method by highlighting the interaction between the handle (102), the clamping device (200), and the connection mechanism (101) to achieve the desired clamping effect. This method not only ensures secure retention of fitness equipment but also facilitates adjustment and operation, making the clamping device (200) versatile and user-friendly.

In this embodiment, preferably, the connection mechanism (101) may include a snap structure, a magnetic adsorption structure, or an adhesive structure to fix the fitness equipment. These structures may be integrated into the connection mechanism (101) to provide additional fixing options for the fitness equipment. The snap structure can cooperate with corresponding features on the fitness equipment to hold it in an appropriate position. The magnetic adsorption structure can utilize magnetic force to securely attract and hold the fitness equipment. The adhesive structure may involve an adhesive material on the connection mechanism (101) for attaching to the fitness equipment. These fixing options can be selected according to specific requirements of the fitness equipment and a desired safety level. The connection mechanism (101) may be designed to accommodate these structures, thereby flexibly securing different types of fitness equipment. Integration of these structures may enhance overall functionality of the clamping device (200) by providing multiple fixing options. Appropriate selection of fixing structures may depend on factors such as the material of the fitness equipment, the environment in which it is used, and a desired ease of installation and removal. The connection mechanism (101) may be configured to allow easy interchangeability of these protective structures, permitting customization based on user preferences. Use of such structures may contribute to stability and reliability of the clamping device (200), ensuring that fitness equipment remains securely held during operation.

In this embodiment, preferably, for the clamping device of fitness equipment, side walls of the U-shaped groove (105) can be utilized to effectively position the fitness equipment. Such positioning can be achieved by aligning a peripheral side of a central portion of the fitness equipment with the side walls, which may help achieve a stable positioning state. The fitness equipment can then be fixed in this positioned state using the handle (102) and the clamping device (200), ensuring that the equipment is firmly clamped. The connection mechanism (101) may include the U-shaped groove (105) and may be configured to allow the clamping device (200) to move relative to the handle (102), thereby progressively tightening the fitness equipment within the holding space. This action may be critical to preventing any lateral deflection or loosening of the fitness equipment during use. In addition, a cushioning pad may be part of the connection mechanism (101) and may generate friction with the outer wall of the fitness equipment to provide a buffering effect for further stabilizing the equipment. The snap structure, magnetic adsorption structure, or adhesive structure may also be integrated into the connection mechanism (101) to provide additional fixing options and improve overall stability and safety of the fitness equipment.

The clamping device (200) may be designed to accommodate fitness equipment of different diameters so as to prevent slipping and to hold the equipment firmly in place. Durable materials of the clamping device (200) can withstand repeated use and forces applied during clamping, contributing to service life and reliability of the device. In addition, a lightweight and portable design of the clamping device (200) may facilitate transport and storage, making it a versatile tool for securing fitness equipment.

In this embodiment, preferably, the clamping device (200) may be designed to accommodate fitness equipment of different diameters to potentially prevent slipping and to firmly secure the equipment. The capability of the clamping device (200) to accommodate fitness equipment of different diameters promotes this effect. The clamping device (200) may include the connection mechanism (101), which allows progressive tightening of the fitness equipment within the holding space formed between the handle (102) and the clamping device (200). The connection mechanism (101) may enable the clamping device (200) to move relative to the handle (102) so as to adjust to a size of the fitness equipment and to ensure a secure fit. The clamping device (200) may also be made of durable materials, enabling it to withstand repeated use and forces applied during clamping. Such durability may contribute to reliability and service life of the device. In addition, the clamping device (200) may be lightweight and portable, facilitating transport and storage. A combination of these features may provide a versatile and effective solution for securing fitness equipment of various sizes by providing a safe and reliable clamping mechanism, thereby improving user experience.

In this embodiment, preferably, the clamping device (200) may be formed of a durable material capable of withstanding repeated use and forces applied during clamping. This configuration can ensure service life and reliability of the clamping device (200). A durable material may be selected to resist wear, thereby maintaining device functionality over time. The clamping device (200) may also be designed to accommodate fitness equipment of various sizes, prevent slipping, and securely fix the equipment. Such adaptability may be achieved by using the connection mechanism (101) that allows the clamping device (200) to move relative to the handle (102) and to progressively tighten the fitness equipment within the holding space. The clamping device (200) is lightweight and portable, which facilitates transport and storage. This portability may be beneficial for users who need to move or store the clamping device (200) when securing equipment. A combination of durability, adaptability, and portability may contribute to overall effectiveness and user-friendliness of the clamping device (200).

In this embodiment, preferably, the clamping device (200) may be designed to be lightweight and portable for easy transport and storage. This feature may be particularly advantageous for users who require mobility or frequent relocation of equipment. The lightweight characteristic of the clamping device (200) may be achieved by using materials that provide sufficient strength while minimizing weight. Portability of the device may be further enhanced by its compact design, allowing convenient storage at different locations. A combination of these features may ensure that the clamping device (200) can be easily handled and transported without compromising its functionality or durability.

The foregoing description is merely of optional embodiments of the present invention and is not intended to limit the scope of the present invention. Any equivalent structural transformations made based on the inventive concept of the present invention using the content of the present specification and the accompanying drawings, or any direct or indirect application of the inventive concept to other related technical fields, shall fall within the scope of protection of the present invention.

The invention claimed is:

1. A fitness equipment clamping device, comprising:

a connection mechanism having an umbrella-shaped configuration and a handle disposed at a top portion of the connection mechanism;

a support device disposed at a bottom portion of the connection mechanism, the support device comprising a first support plate and a second support plate, the first support plate and the second support plate each having external threads formed on an outer surface thereof;

a clamping device disposed below the connection mechanism, the clamping device comprising a knob assembly having internal threads, the internal threads of the knob assembly being configured to threadedly engage with the external threads of the first support plate and the second support plate; and a U-shaped groove formed between the connection mechanism and the clamping device, the U-shaped groove being configured to receive and secure a handle portion of fitness equipment;

wherein the clamping device is detachably connectable to the connection mechanism by threading the knob assembly onto the first support plate and the second support plate in a bottom-up direction to clamp the fitness equipment within the U-shaped groove.

2. The fitness equipment clamping device of claim 1, wherein the knob assembly includes a boss, and the support device is configured to connect to the knob assembly via the boss.

3. The fitness equipment clamping device of claim 2, wherein a back side of the boss defines a boss cavity, a hollow first tubular post is disposed within the boss cavity, the knob assembly defines a knob cavity, and a knob post is disposed within the knob cavity at a position corresponding to a position of the first tubular post, the knob post being insertably engageable with the first tubular post.

4. The fitness equipment clamping device of claim 3, wherein second and third tubular posts are respectively disposed on opposite lateral sides of the first tubular post.

5. The fitness equipment clamping device of claim 4, wherein the knob cavity further defines a recess configured to receive the second tubular post and the third tubular post so that the second tubular post and the third tubular post abut against a bottom surface of the recess when the boss is inserted into the knob cavity.

6. The fitness equipment clamping device of claim 4, wherein opposite sides of the boss respectively define a first limiting portion and a second limiting portion that are positioned to correspond to the first support plate and the second support plate, and wherein the first support plate and the second support plate are respectively configured to couple to the knob assembly through the first limiting portion and the second limiting portion.

7. The fitness equipment clamping device of claim 2, wherein a top surface of the boss is provided with a cushioning pad configured to contact an outer surface of the fitness equipment received in the U-shaped groove.

8. The fitness equipment clamping device of claim 1, wherein the first support plate and the second support plate are respectively disposed at opposite lateral ends of the bottom portion of the connection mechanism.

9. The fitness equipment clamping device of claim 1, wherein the handle includes a nut member disposed inside the handle and configured to threadedly engage with a bar portion of an external fitness equipment component, wherein said bar portion is distinct from the handle portion of the fitness equipment that is received and secured within the U-shaped groove.

10. The fitness equipment clamping device of claim 1, wherein the U-shaped groove is configured to accommodate dumbbells having different handle diameters by progressively tightening the knob assembly along the external threads of the first support plate and the second support plate.

* * * * *